US007675494B2

(12) United States Patent
Hong et al.

(10) Patent No.: US 7,675,494 B2
(45) Date of Patent: Mar. 9, 2010

(54) ORGANIC LIGHT-EMITTING DEVICE AND ORGANIC LIGHT-EMITTING DISPLAY

(75) Inventors: Soon Kwang Hong, Daegu (KR); In Gyo Seo, Daegu (KR)

(73) Assignee: LG Display Co., Ltd., Seoul (KR)

( * ) Notice: Subject to any disclaimer, the term of this patent is extended or adjusted under 35 U.S.C. 154(b) by 975 days.

(21) Appl. No.: 11/298,506

(22) Filed: Dec. 12, 2005

(65) Prior Publication Data

US 2006/0290613 A1 Dec. 28, 2006

(30) Foreign Application Priority Data

Jun. 27, 2005 (KR) ..... 10-2005-0055570

(51) Int. Cl.
*G09G 3/32* (2006.01)

(52) U.S. Cl. ..... 345/82; 345/76

(58) Field of Classification Search ..... 345/76–83, 345/204

See application file for complete search history.

(56) References Cited

U.S. PATENT DOCUMENTS

| | | | | |
|---|---|---|---|---|
| 6,650,060 | B2 * | 11/2003 | Okuda | 315/169.1 |
| 6,891,520 | B2 * | 5/2005 | Chen et al. | 345/82 |
| 2003/0043131 | A1 * | 3/2003 | Iguchi | 345/204 |
| 2003/0214465 | A1 * | 11/2003 | Kimura | 345/76 |
| 2004/0041750 | A1 * | 3/2004 | Abe | 345/76 |
| 2004/0066357 | A1 * | 4/2004 | Kawasaki | 345/76 |
| 2005/0007181 | A1 * | 1/2005 | Kimura | 327/524 |
| 2005/0007357 | A1 * | 1/2005 | Yamashita et al. | 345/204 |

FOREIGN PATENT DOCUMENTS

CN 1555548 12/2004

* cited by examiner

*Primary Examiner*—Sumati Lefkowitz
*Assistant Examiner*—Robert E Carter, III
(74) *Attorney, Agent, or Firm*—McKenna Long & Aldridge

(57) ABSTRACT

An organic light-emitting device including: a light emitting diode that emits light by a signal current; a driving thin film transistor connected between a source voltage and a light emitting diode and connected at its drain to the light emitting diode and a current source, and that supplies the signal current to the light emitting diode depending on display data; a storage capacitor connected between the source voltage and a gate of the driving thin film transistor, and that stores the display data depending on a display data signal; a first switching unit connected between the drain of the driving thin film transistor and a data driver and connected at its gate with a first scan line, wherein the first switching unit and selects the data signal; a second switching unit connected between the gate and the drain of the driving thin film transistor and connected at its gate with a second scan line wherein, the second switching unit drives the driving thin film transistor; and a third switching unit connected between the drain of the driving thin film transistor and the light emitting diode and connected at its gate with a third scan line, wherein the third switch unit selects the signal current applied to the light emitting diode.

4 Claims, 8 Drawing Sheets

ORGANIC LIGHT-EMITTING DEVICE AND ORGANIC LIGHT-EMITTING DISPLAY

This nonprovisional application claims the benefit of Korean Patent Application No. 10-2005-0055570, filed on Jun. 27, 2005, which is hereby incorporated by reference for all purposes as if fully set forth herein.

BACKGROUND OF THE INVENTION

1. Field of the Invention

The present invention relates to an organic light-emitting device and an organic light-emitting display using the same.

2. Discussion of the Related Art

An organic light-emitting diode (OLED) is an active light-emitting device that excites a phosphor and emits light by a recombination of electrons and holes. An organic light-emitting display including the organic light-emitting diode may be used in a wall mounted device or a portable device due to its fast response speed, low direct-current driving voltage, and ultra thinness, in comparison to a passive light-emitting device needing a separate light source such as a liquid crystal display.

The organic light-emitting diode produces a color using pixels where red, green, and blue sub pixels combine to a color. In a method of driving the subpixel, the organic light-emitting diode may be classified into a passive matrix organic light-emitting diode (PMOLED), and an active matrix organic light-emitting diode (AMOLED) employing a driving method using a thin film transistor (TFT).

The driving method of the active matrix organic light-emitting diode (AMOLED) may be classified into a current driving method, a voltage driving method, and a digital driving method.

FIG. 1 is an equivalent circuit diagram illustrating a conventional current driving active matrix organic light-emitting device (AMOLED), and FIG. 2 is a driving timing diagram of FIG. 1.

Referring to FIG. 1, the conventional organic light-emitting device 50 includes a first TFT (M2), a second TFT (M3), a first switch (S/W5), a second switch (S/W6), a storage capacitor (Cst), and an organic light-emitting diode (OLED).

The first and second TFTs (M2 and M3) have a mirror structure to supply a constant current to the organic light emitting diode (OLED), are connected at their sources with a source voltage (VDD), and are connected at their gates to the storage capacitor (Cst). The drain of the first TFT (M2) connects to the organic light emitting diode, and the drain of the second TFT (M3) connects between the first and second switches (S/W5 and S/W6).

Referring to FIGS. 1 and 2, the first and second switches (S/W5 and S/W6) are series connected between the gates of the first and second TFTs (M2 and M3) and a data line. The first and second switches (S/W5 and S/W6) are connected at their gates with a scan line, and switch the data signal (data n) by the scan signal (scan n) of FIG. 2 applied through the scan line.

The storage capacitor (Cst) is between the gates of the first and second TFTs (M2 and M3) and the second switch (S/W6), and stores the data voltage from the source voltage (VDD) by the data signal (data[n]) of FIG. 2.

The organic light-emitting diode (OLED) emits light by a current generated from the first TFT (M2) driven by the data voltage stored in the storage capacitor (Cst). A gray level of the organic light-emitting diode (OLED) is determined by the amount of the signal current. For a high gray level, a larger signal current is supplied to the organic light-emitting diode (OLED), and for a low gray level, a smaller signal current is supplied to the organic light-emitting diode (OLED).

However, the conventional organic light-emitting device has a drawback in that when a low gray level is displayed, in comparison a current supplied from a data driver is dozens of nA. Then the storage capacitor cannot be charged with a desired data voltage due to a data line load on the data line between the data driver and a pixel before the storage capacitor of the pixel is charged with the desired data voltage.

In other words, the conventional organic light-emitting device has a drawback in that when a low gray level is displayed, due to the data line load, the storage capacitor (Cst) cannot be sufficiently charged with a current of dozens of nA during a gate on time of several msec.

As a result, the conventional organic light-emitting display having a pixel circuit including the organic light-emitting device has a drawback in that it cannot be put to practical use due to the deterioration of the capability to display a low gray level.

SUMMARY OF THE INVENTION

Accordingly, the present invention is directed to organic light-Emitting device and organic light-emitting display that substantially obviates one or more of the problems due to limitations and disadvantages of the related art.

An advantage of the present invention is to solve at least the problems and disadvantages of the background art.

Another advantage of the present invention is to provide an organic light-emitting device and an organic light-emitting display using the same, in which when a low gray level is displayed, a storage capacitor is sufficiently charged, thereby improving a capability to display low gray levels.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an organic light-emitting device including: a light emitting diode that emits light by a signal current; a driving thin film transistor connected between a source voltage and a light emitting diode and connected at its drain to the light emitting diode and a current source, and that supplies the signal current to the light emitting diode depending on display data; a storage capacitor connected between the source voltage and a gate of the driving thin film transistor, and that stores the display data depending on a display data signal; a first switching unit connected between the drain of the driving thin film transistor and a data driver and connected at its gate with a first scan line, wherein the first switching unit and selects the data signal; a second switching unit connected between the gate and the drain of the driving thin film transistor and connected at its gate with a second scan line wherein, the second switching unit drives the driving thin film transistor; and a third switching unit connected between the drain of the driving thin film transistor and the light emitting diode and connected at its gate with a third scan line, wherein the third switch unit selects the signal current applied to the light emitting diode.

In another aspect of the present invention, an organic light-emitting device including: a storage capacitor that stores a data voltage from a source voltage when a reference current and a data current are sunk depending on a data signal; a driving thin film transistor that receives the data voltage depending on a scan signal and supplying the reference current and the data current corresponding to the data voltage; a reference current source that outputs the reference current supplied from the driving thin film transistor; a light emitting diode that emits light by the data current supplied from the driving thin film transistor; and a switching unit that switches the data signal or the data current according to the scan signal.

In another aspect of the present invention, an organic light-emitting display including: a data driver that supplies a data signal through a data line; a scan driver that supplies a scan signal through a scan line; and an organic light-emitting device disposed at an intersection of the data line and the scan line, and the organic light-emitting device emitting light corresponding to a signal current, the organic light-emitting device including: a light emitting diode that emits light by a signal current; a driving thin film transistor connected between a source voltage and the light emitting diode and connected at its drain to the light emitting diode and a current source, and the driving thin film transistor that supplies the signal current to the light emitting diode depending on display data; a storage capacitor connected between the source voltage and a gate of the driving thin film transistor, and that stores the display data depending on a display data signal; a first switching unit connected between the drain of the driving thin film transistor and a data driver and connected at its gate with a first scan line, wherein the first switching unit selects the data signal; a second switching unit connected between the gate and the drain of the driving thin film transistor and connected at its gate with a second scan line, wherein the second switching unit drives the driving thin film transistor; and a third switching unit connected between the drain of the driving thin film transistor and the light emitting diode and connected at its gate with a third scan line and a source connected to the source voltage, wherein the third switching unit selects the signal current applied to the light emitting diode.

In another aspect of the present invention, An organic light-emitting device including: a storage capacitor that stores a data voltage from a source voltage when a double reference current and a data current are sunk depending on a data signal; a driving thin film transistor that receives the data voltage depending on a scan signal and supplying the double reference current and the data current corresponding to the data voltage; a reference current source that outputs the reference current supplied from the driving thin film transistor and then outputting the double reference current depending on the data signal; a light emitting diode that emits light by the data current supplied from the driving thin film transistor; and a switching unit that switches the data signal, the data current, and the reference current by the scan signals.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF PREFERRED EMBODIMENTS

Reference will now be made in detail to an embodiment of the present invention, example of which is illustrated in the accompanying drawings.

Embodiments of the present invention will be described in a more detailed manner with reference to the drawings.

First Embodiment

Figure 1:
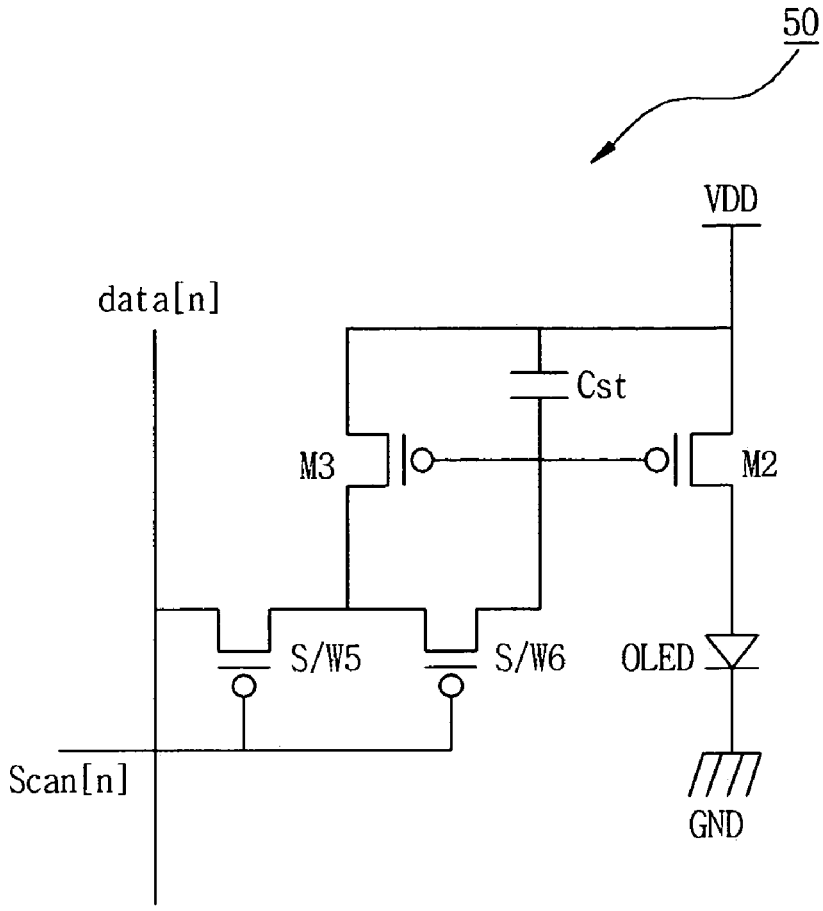
FIG. 1 is an equivalent circuit diagram illustrating a conventional organic light-emitting device.
Figure 2:
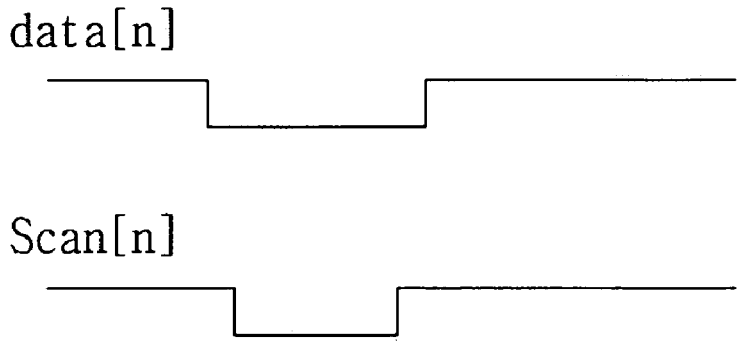
FIG. 2 is a driving timing diagram of FIG. 1.
Figure 3:
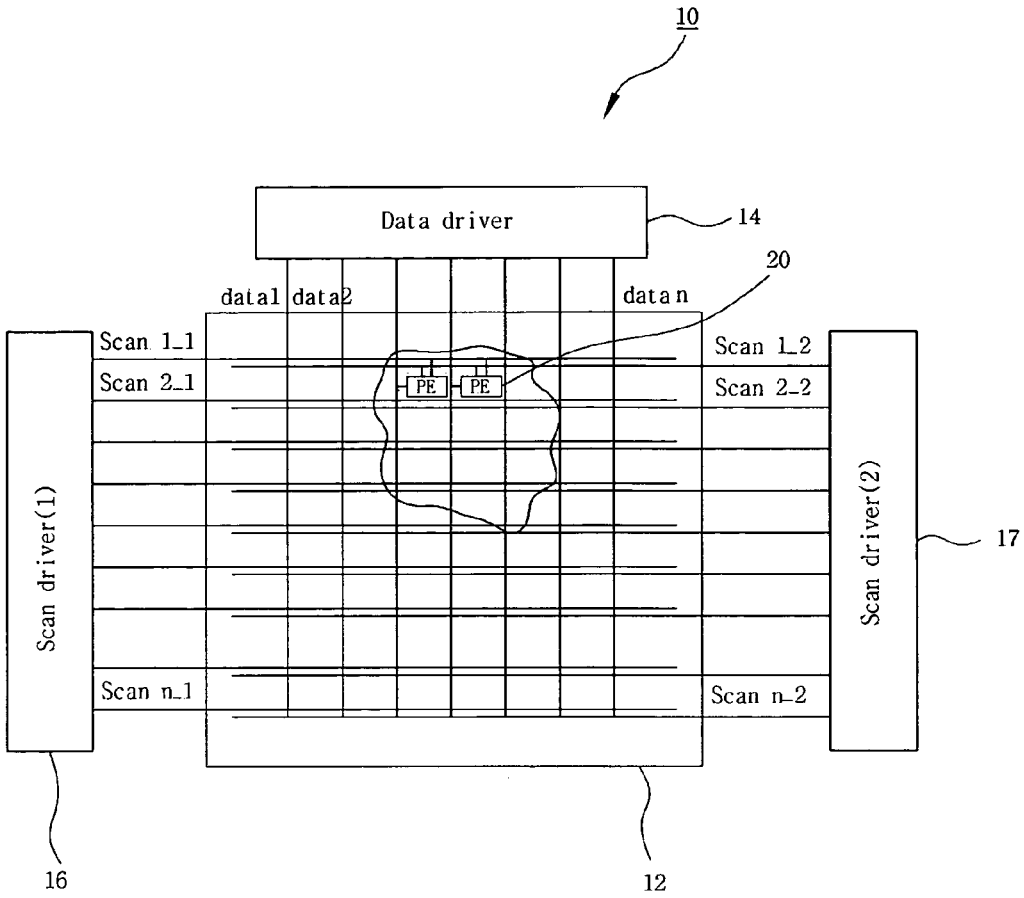
FIG. 3 illustrates the structure of an organic light-emitting display according to the first embodiment of the present invention.

FIG. 3 illustrates the structure of an organic light-emitting display according to the first embodiment of the present invention.

Referring to FIG. 3, the organic light-emitting display 10 includes a pixel circuit 12, a data driver 14, and two scan drivers 16 and 17. The pixel circuit 12 receives data signals (data 1, data 2, . . . , data n) from the data driver 14 through a plurality of data lines, and receives scan signals (scan 1_1, scan 2_1 . . . scan n_1/scan 1_2, scan 2_2 . . . scan n_2) from the scan drivers 16 and 17 through a plurality of scan lines. The pixel circuit 12 has a plurality of organic light-emitting devices 20 disposed at intersections of the data lines and the scan lines and emits light according to the data signal and the scan signal.

Figure 4:
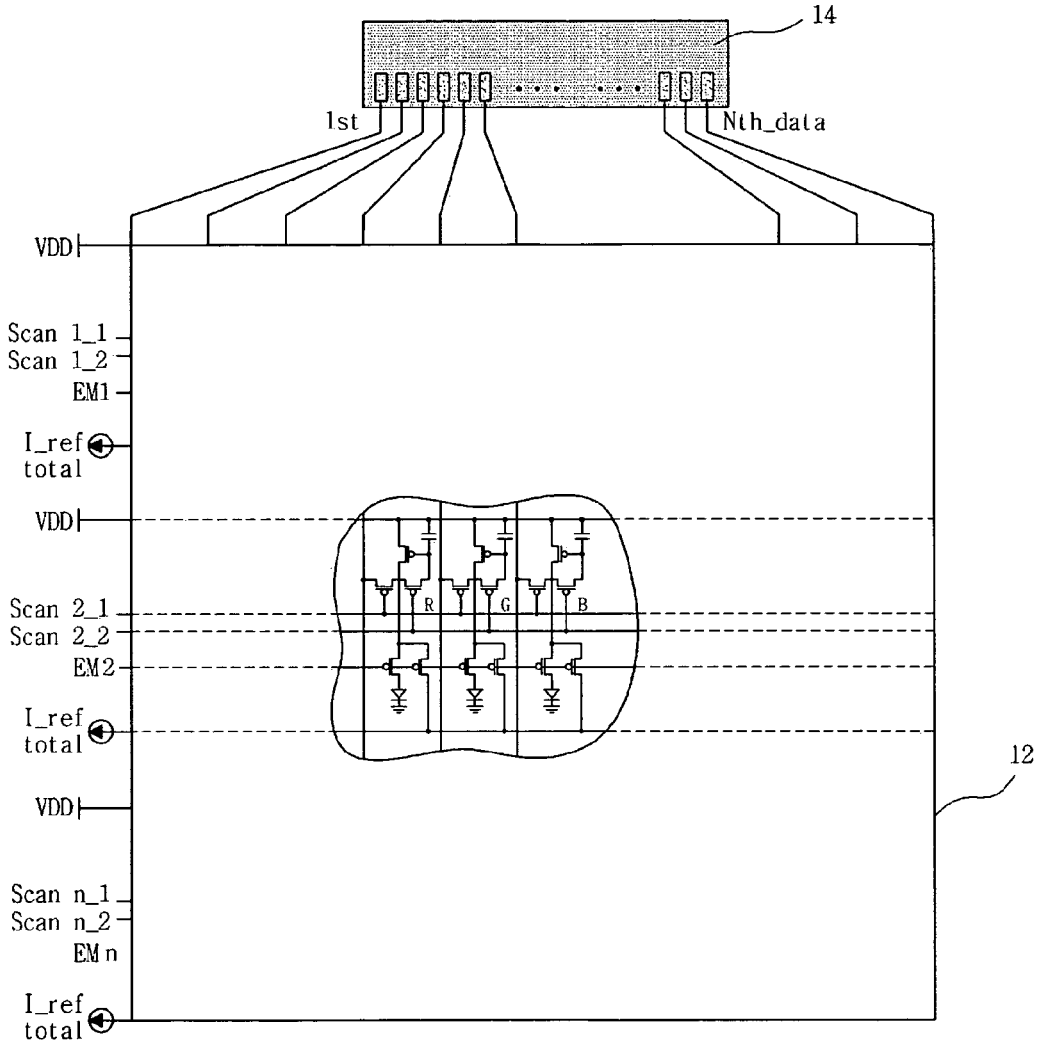
FIG. 4 illustrates a data driver and a pixel circuit of FIG. 3.

FIG. 4 illustrates the structure of the data driver and the pixel circuit of FIG. 3. The data driver 14 and the pixel circuit part 12 will be described in detail with reference to FIG. 4.

Referring to FIG. 4, in the pixel circuit 12, red, green, and blue organic light-emitting devices or sub pixels 20 are grouped as one group, thereby forming a pixel. Further, the organic light-emitting devices or sub pixels 20 include the data line (data n), three scan lines (scan n_1, scan n_2, EM n), a source voltage (VDD), a ground (GND) line (not shown), and a reference current source (I_ref) line to receive the data signal, the scan signal, the source voltage, and a reference current, respectively.

Figure 5:
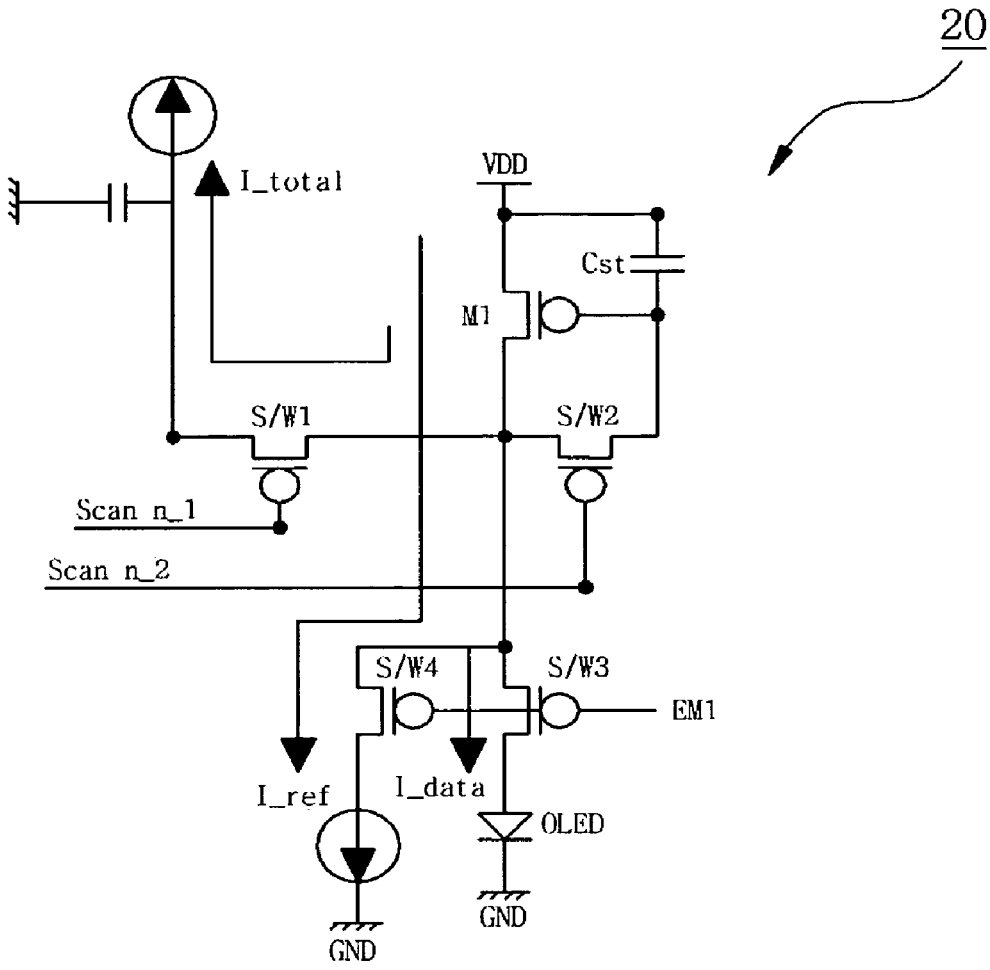
FIG. 5 is an equivalent circuit diagram illustrating an organic light-emitting device according to the first embodiment of the present invention.

FIG. 5 is an equivalent circuit diagram illustrating an organic light-emitting device according to the first embodiment of the present invention.

Referring to FIG. 5, the organic light-emitting device 20 is a current driving active matrix organic light-emitting device. The organic light-emitting device 20 includes a driving thin film transistor (TFT) (MI), first to fourth switches (S/W1 to S/W4), a storage capacitor (Cst), and an organic light-emitting diode (OLED). The driving TFT (M1) is a P-channel metal oxide semiconductor field effect transistor (MOSFET).

The source of the driving TFT (M1) is connected to the source voltage (VDD), and the gate of the driving TFT (M1) is connected to the storage capacitor (Cst) and the second switch (S/W2).

The first switch (S/W1) is disposed between a drain of the driving TFT (M1) and the data line. Further, the first switch (S/W1 is connected at its gate with a first scan line and receives a first scan signal (scan n_1), thereby switching the data signal or a data current (I_total). At this time, the level of the data current (I_total) is the same as a sum of the reference current (I_ref) and the signal current (I_data).

The second switch (S/W2) is connected between the gate and the drain of the driving TFT (M1). Further, the gate of the second switch (S/W2) is connected to a second scan line and receives a second scan signal (scan n_2), thereby switching the data signal or the data current (I_total) together with the first switch (S/W1).

The storage capacitor (Cst) is disposed between the source voltage (VDD) and the source and the gate of the driving TFT (M1), and stores the data voltage from the source voltage (VDD) when the data current (I_total) is sunk.

The third switch (S/W3) is disposed between the drain of the driving TFT (M1) and the organic light-emitting diode (OLED), and the fourth switch (S/W4) is disposed between the drain of the driving TFT (M1) and a reference current source. The gates of the third and fourth switches (S/W3 and S/W4) are commonly connected to a third scan line to which a third scan signal (EM1) is applied. If the third scan signal is applied, the third and fourth switches (S/W3 and S/W4) switch so that current supplied to the driving TFT (M1) driven by the data voltage stored in the storage capacitor (Cst) splits into the reference current (I_ref) and the signal current (I_data), and the reference current (I_ref) and the signal current (I_data) flow to the reference current source and the organic light-emitting diode (OLED), respectively.

Last, the organic light-emitting diode (OLED) emits light according to the signal current (I_data). The organic light-emitting diode (OLED) is comprised of an anode and a cathode, electron and hole transport layers, and an organic light-emitting layer disposed therebetween, and the organic light-emitting diode (OLED) emits light while recombining electrons and holes in the organic light-emitting layer according to the signal current (I_data).

A gray level of the organic light-emitting diode (OLED) is determined by the amount of signal current. That is, for a high gray level a larger signal current is supplied to the organic light-emitting diode (OLED), and for a low gray level a smaller signal current is supplied to the organic light-emitting diode (OLED).

Figure 6:
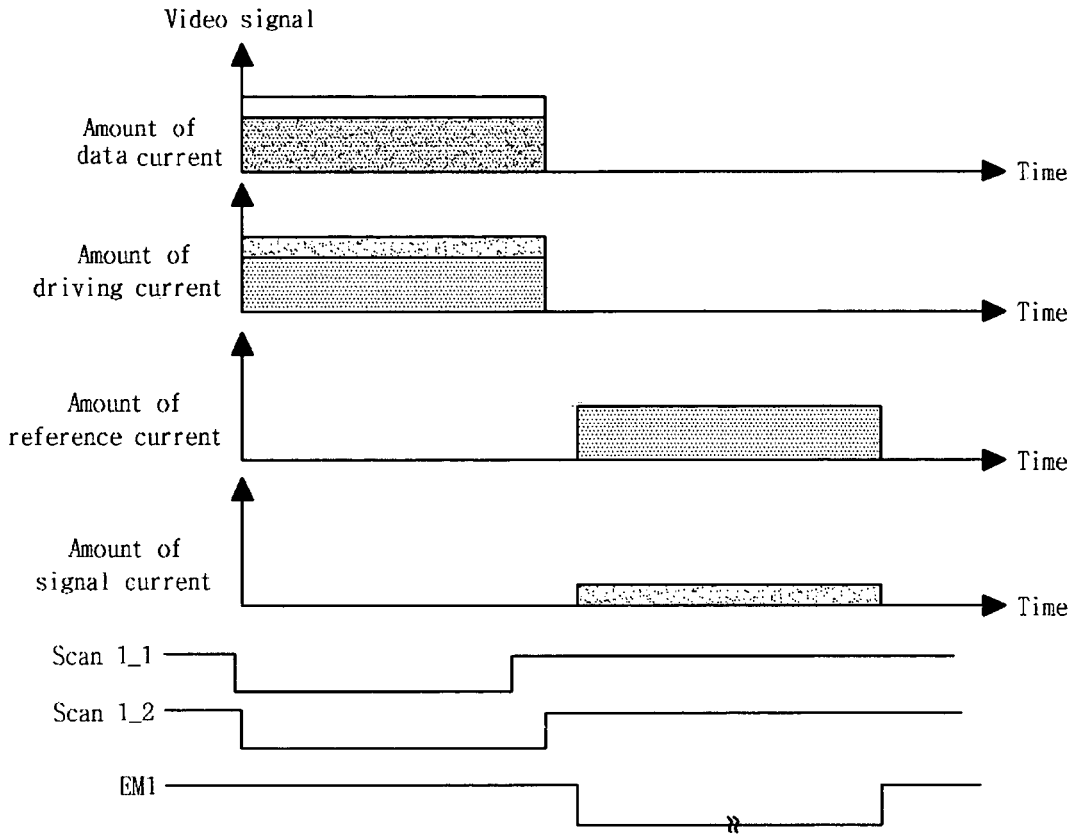
FIG. 6 is a plot showing current versus driving timing for FIG. 5.

FIG. 6 is a plot showing current verses driving timing for FIG. 5. In order of bottom to top, FIG. 6 illustrates timing diagrams of the third scan signal (EM1), the second scan signal (scan n_2), and the first scan signal (scan n_1), and illustrates the amount of signal current (I_data), the amount of reference current (I_ref), the amount of driving current of the driving TFT (M1), and the amount of data current (I_total). They are illustrated in FIG. 6 so as to describe how the current varies depending on the timing of the scan signals.

Hereinafter, a process of driving the organic light-emitting diode 20 according to the first embodiment of the present invention will be described with reference to FIGS. 5 and 6.

In a state where the data signal is applied to a terminal of the first switch (S/W1), if the first and second scan signals (scan n_1 and scan n_2) are applied to the gates of the first and second switches (S/W1 and S/W2) respectively, the driving TFT (M1) is turned on due to a common node of the gate and the drain of the driving TFT (M1), thereby sinking the data current (I_total) from the source voltage (VDD) to the data driver 14 of FIG. 3 via the first switch (S/W1) through the data line. While the data current (I_total) flows, the data voltage proportional to the amount of the flowing data current (I_total) is stored in the storage capacitor (Cst) during a gate on time.

The amount of data current (I_total) is identical with a sum of the reference current (I_ref) and the signal current (I_data). Therefore, even though the signal current (I_data) is less, it is added to the reference current (I_ref) so that not only the storage capacitor (Cst) but also the data line load can be sufficiently charged during the gate on time. Accordingly, when displaying a low gray level and the signal current (I_data) is less, the amount of reference current (I_ref) is sufficiently large and therefore, not only the storage capacitor (Cst) but also the data line load can be sufficiently charged during the gate on time.

If the first and second scan signals (scan n_1 and scan n_2) are erased and the third scan signal (EM1) is applied to the gates of the third and fourth switches (S/W3 and S/W4), the driving TFT (M1) is driven by the data voltage of the storage capacitor (Cst). At this time, the driving current (I_M1) output to the drain of the driving TFT (M1) becomes identical with the data current (I_total) when the data voltage is the same as or greater than a threshold voltage of the driving TFT (M1).

The amount of data current (I_total) is split into the reference current (I_ref) and the signal current (I_data) to flow to the reference current source (I_ref) and the organic light-emitting diode (OLED), respectively. The signal current (I_data) drives the organic light-emitting diode (OLED) light.

Second Embodiment

Figure 7:
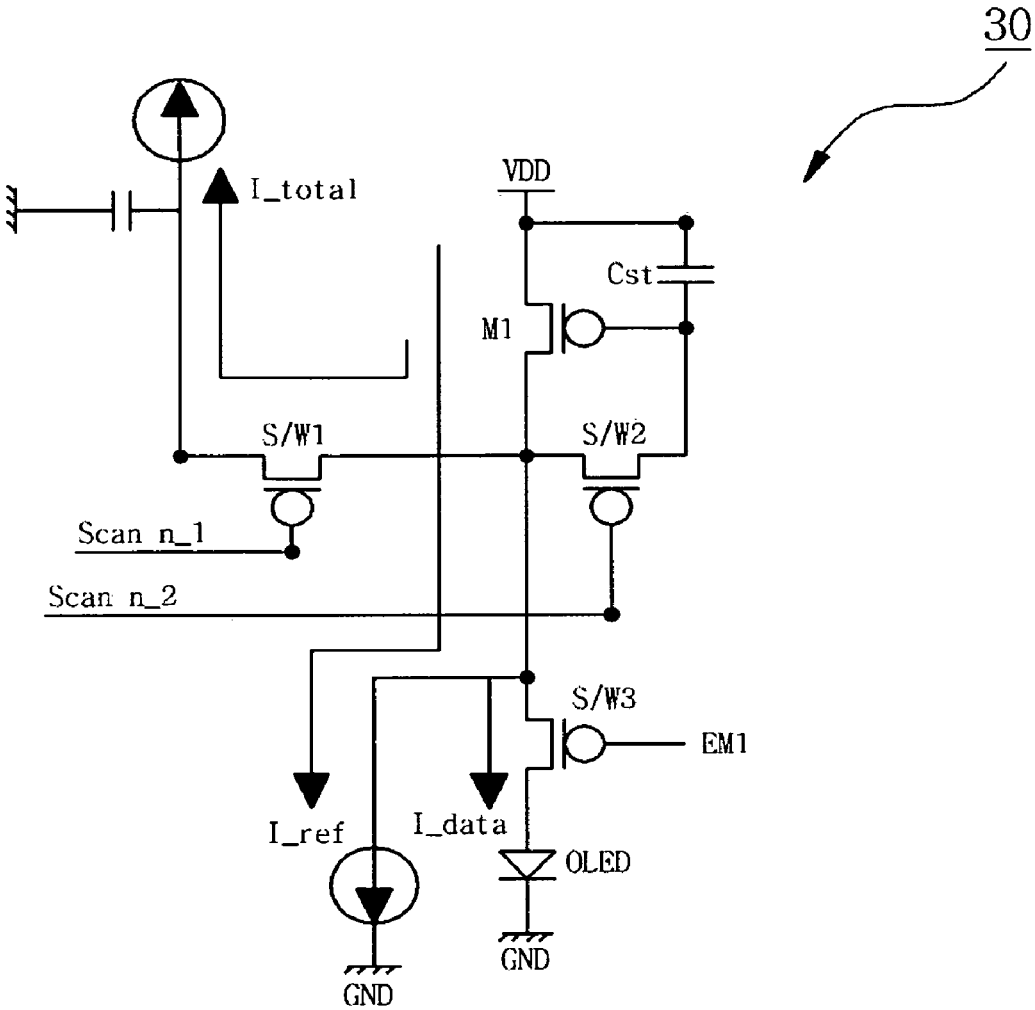
FIG. 7 is an equivalent circuit diagram illustrating an organic light-emitting device according to the second embodiment of the present invention.
Figure 8:
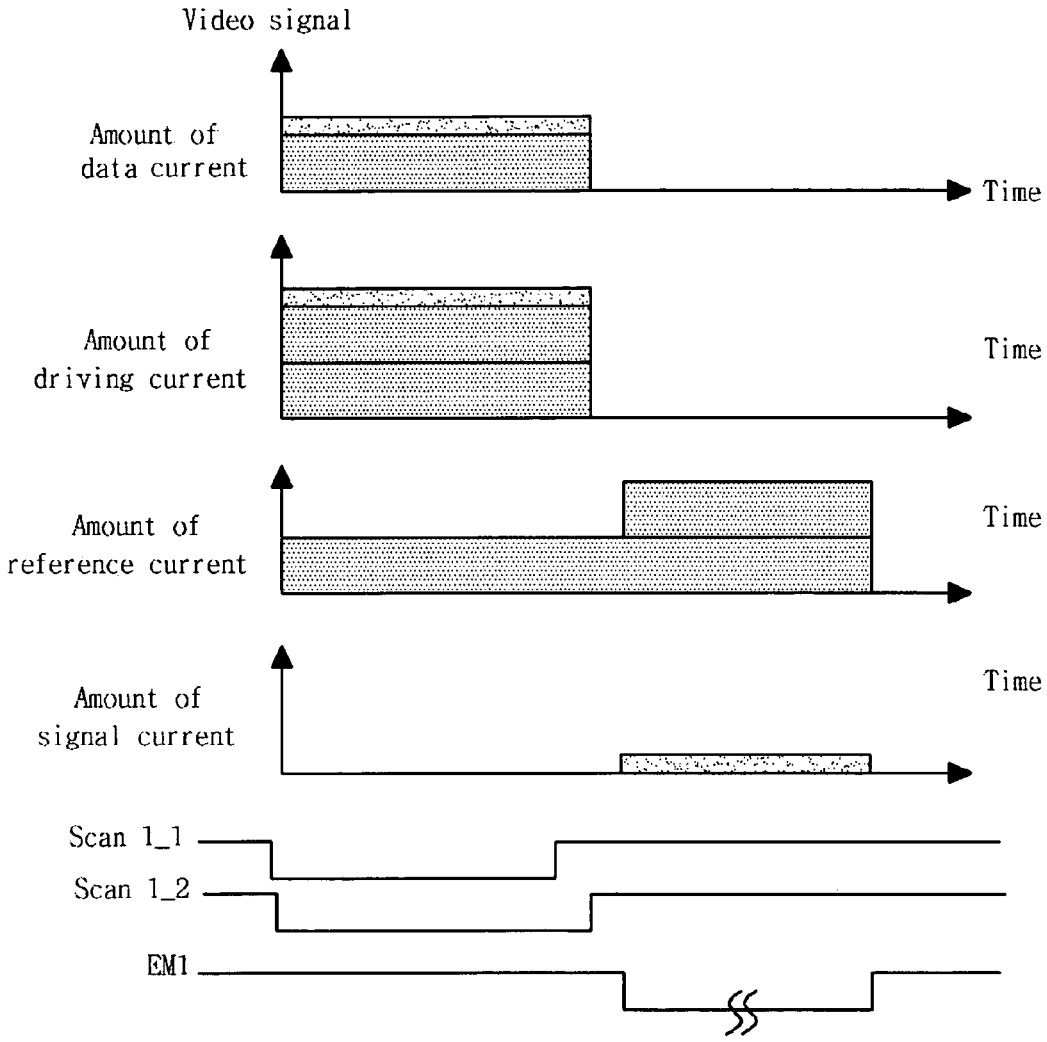
FIG. 8 is a plot showing current versus driving timing for FIG. 7.

FIG. 7 is an equivalent circuit diagram illustrating an organic light-emitting device according to the second embodiment of the present invention, and FIG. 8 is a plot showing current versus driving timing for FIG. 7.

Referring to FIGS. 7 and 8, the organic light-emitting device 30 is a current driving active matrix organic light-emitting device and is the same as the organic light-emitting device 20 according to the first embodiment of the present invention regarding its connections to the driving TFT (M1), first to third switches (S/W1 to S/W3), the storage capacitor (Cst), and the organic light-emitting diode (OLED).

However, the inventive organic light-emitting device 30 excludes a fourth switch (S/W4) unlike the organic light-emitting device 20 according to the second embodiment. If the first and second scan signals (scan n_1 and scan n_2) are applied to the gates of the first and second switches (S/W1 and S/W2), respectively, the driving TFT (M1) is turned on due to the exclusion of the fourth switch (S/W4) so that the data current (I_total) corresponding to a sum of the reference current (I_ref) and the signal current (I_data) is sunk into the data driver (14 of FIG. 3) from the source voltage (VDD) through the data line, and the reference current (I_ref) is sunk into the reference current source.

Accordingly, the driving current that drives the driving TFT (M1) becomes identical with a sum of the data current (I_total) and the reference current (I_ref), and the data voltage corresponding to the driving current is stored in the storage capacitor (Cst). Accordingly, even though the signal current (I_data) is less, it is added to the reference current (I_ref) so that not only the storage capacitor (Cst) but also the data line load can be sufficiently charged during the gate on time. Accordingly, when displayind a low gray level and the signal current (I_data) is less, the amount of reference current (I_ref) is sufficiently large and therefore, not only the storage capacitor (Cst) but also the data line load can be sufficiently charged during the gate on time.

If the first and second scan signals (scan n_1 and scan n_2) are erased and the third scan signal (EM1) is applied to the gate of the third switch (S/W3), the driving TFT (M1) is driven by the data voltage of the storage capacitor (Cst).

Driving current is the same as a sum of the data current (I_total=I_ref+I_data), which corresponds to a total sum of the reference current (I_ref) and the signal current (I_data), and the reference current (I_ref). The data current is split into the reference current (2×I_ref) and the signal current (I_data) to flow to the reference current source and the organic light-emitting diode (OLED), respectively. The signal current (I_data) drives the organic light-emitting diode (OLED) to emit.

Third Embodiment

Figure 9:
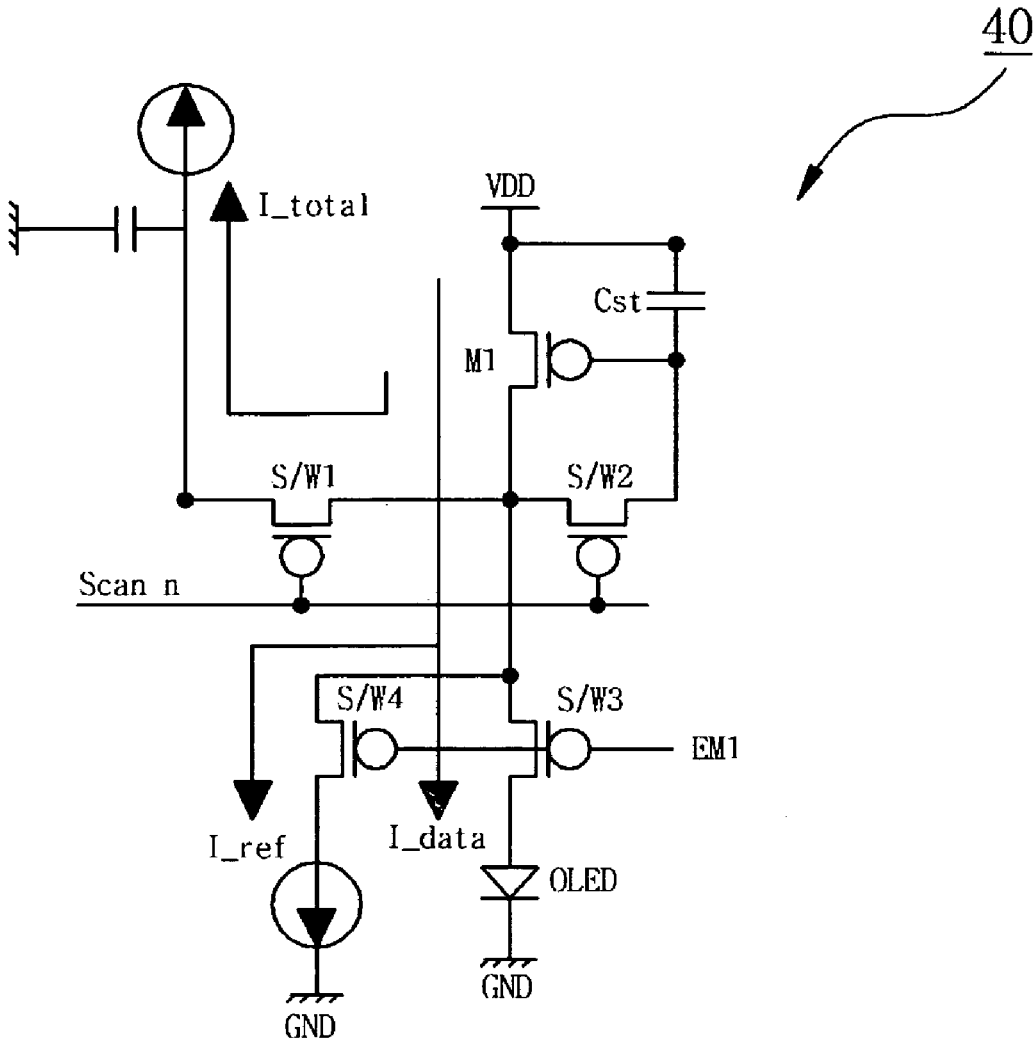
FIG. 9 is an equivalent circuit diagram illustrating an organic light-emitting device according to the third embodiment of the present invention.

FIG. 9 is an equivalent circuit diagram illustrating an organic light-emitting device according to the third embodiment of the present invention. A plot showing current versus timing of the organic light-emitting device according to the third embodiment of the present invention is the same as that of FIG. 6. Accordingly, FIG. 6 is referred to.

Referring to FIGS. 6 and 9, the inventive organic light-emitting device 40 is a current driving active matrix organic light emitting device and is the same as the organic light-emitting device 20 according to the first embodiment of the present invention with respect to the connections between the driving TFT (M1), first to fourth switches (S/W1 to S/W4), the storage capacitor (Cst), and the organic light-emitting diode (OLED).

However, the inventive organic light-emitting device 40 is different from the organic light-emitting device 20 according to the second embodiment of the present invention, in that the same scan signal (scan) is concurrently applied to or erased from the first and second switches (S/W1 and S/W2) through one scan line.

By the above structure, the present invention when displaying a low gray level, the signal current (I_data) is smaller and the reference current (I_ref) is sufficiently large and therefore, the storage capacitor can be sufficiently charged, thereby improving a capability to display low gray level.

Accordingly, an organic light-emitting display can be provided where the capability to display a low gray level is excellent.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light-emitting device comprising:

a light emitting diode that emits light by a signal current;

a driving thin film transistor connected between a source voltage and the light emitting diode and connected at its drain to the light emitting diode and a current source, and that supplies the signal current to the light emitting diode depending on display data;

a storage capacitor connected between the source voltage and a gate of the driving thin film transistor, and that stores the display data depending on a display data signal;

a first switching unit connected between the drain of the driving thin film transistor and a data driver and connected at its gate with a first scan line, wherein the first switching unit selects the data signal;

a second switching unit connected between the gate and the drain of the driving thin film transistor and connected at its gate with a second scan line wherein the second switching unit drives the driving thin film transistor;

a third switching unit directly connected between the drain of the driving thin film transistor and the light emitting diode and connected at its gate with a third scan line, wherein the third switch unit selects the signal current applied to the light emitting diode; and a fourth switching unit directly connected between the drain of the driving thin film transistor and the current source and connected at its gate with the third scan line, wherein the fourth switching unit selects a reference current applied to the current source, wherein the third and fourth switching units are of a same transistor type and forms a current mirror circuit.

2. The device of claim 1, wherein the driving thin film transistor and the first to fourth switches are P-channel metal oxide semiconductor field effect transistors.

3. An organic light-emitting display comprising:

a data driver that supplies a data signal through a data line;

a scan driver that supplies a scan signal through a scan line; and an organic light-emitting device disposed at an intersection of the data line and the scan line, and the organic light-emitting device emitting light corresponding to a signal current, the organic light-emitting device including:

a light emitting diode that emits light by a signal current;

a driving thin film transistor connected between a source voltage and the light emitting diode and connected at its drain to the light emitting diode and a current source, and the driving thin film transistor that supplies the signal current to the light emitting diode depending on display data;

a storage capacitor connected between the source voltage and a gate of the driving thin film transistor, and that stores the display data depending on a display data signal;

a first switching unit connected between the drain of the driving thin film transistor and a data driver and connected at its gate with a first scan line, wherein the first switching unit selects the data signal;

a second switching unit connected between the gate and the drain of the driving thin film transistor and connected at its gate with a second scan line, wherein the second switching unit drives the driving thin film transistor;

a third switching unit directly connected between the drain of the driving thin film transistor and the light emitting diode and connected at its gate with a third scan line and a source connected to the source voltage, wherein the third switching unit selects the signal current applied to the light emitting diode; and a fourth switching unit directly connected between the drain of the driving thin film transistor and the current source and connected at its gate with the third scan line, wherein the fourth switching unit selects a reference current applied to the current source, wherein the third and fourth switching units are of a same transistor type and forms a current mirror circuit.

4. The display of claim 3, wherein the driving thin film transistor and the first to fourth switches are P-channel metal oxide semiconductor field effect transistors.

* * * * *